United States Patent [19]

Fair et al.

[11] 4,431,495

[45] Feb. 14, 1984

[54] LOCATION OF A STRUCTURALLY DAMAGED MEMBRANE

[75] Inventors: David L. Fair, Chattanooga; Kenneth E. Woodard, Jr.; David A. Helmstetter, both of Cleveland, all of Tenn.

[73] Assignee: Olin Corporation, New Haven, Conn.

[21] Appl. No.: 489,968

[22] Filed: Apr. 29, 1983

[51] Int. Cl.[3] ..... C25B 1/08; C25B 1/46

[52] U.S. Cl. ..... 204/98; 204/128; 204/257; 204/258; 73/40

[58] Field of Search ..... 204/98, 128, 257, 258; 73/40

[56] References Cited

U.S. PATENT DOCUMENTS

| | | | |
|---|---|---|---|
| 3,811,317 | 5/1974 | Leonard et al. | 73/40 |
| 3,937,064 | 2/1976 | Wolf, Jr. et al. | 73/40 |
| 4,090,924 | 5/1978 | Bon | 204/98 |

*Primary Examiner*—R. L. Andrews
*Assistant Examiner*—Terryence Chapman
*Attorney, Agent, or Firm*—Ralph D'Alessandro; Donald F. Clements; Thomas P. O'Day

[57] ABSTRACT

Disclosed is a method of determining which membrane in a multiple unit filter press membrane electrolytic cell is structurally damaged after cell operating conditions and monitorings indicate the problem exists.

17 Claims, 2 Drawing Figures

LOCATION OF A STRUCTURALLY DAMAGED MEMBRANE

BACKGROUND OF THE INVENTION

This invention relates generally to filter press membrane electrolytic cells. More specifically, it relates to a method for determining which membrane in a multiple unit filter press membrane electrolytic cell has been structurally damaged.

Chlorine and caustic, products of the electrolytic process, are basic chemicals which have become large volume commodities in the industrialized world today. The overwhelming amounts of these chemicals are produced electrolytically from aqueous solutions of alkali metal chlorides. Cells which have traditionally produced these chemicals have come to be known as chloralkali cells. The chloralkali cells today are generally of two principal types, the deposited asbestos diaphragm-type electrolytic cell or the flowing mercury cathode-type.

Comparatively recent technological advances such as the development of dimensionally stable anodes and various coating compositions, have permitted the gap between electrodes to be substantially decreased or eliminated entirely. This has dramatically increased the energy efficiency during the operation of these energy-intensive units.

The development of a hydraulically impermeable membrane has promoted the advent of filter press membrane chloralkali cells which produce a relatively uncontaminated caustic product. This higher purity product obviates the need for caustic purification and concentration processing. The use of a hydraulically impermeable planar membrane has been most common in bipolar filter press membrane electrolytic cells. However, continual advances have been made in the development of monopolar filter press membrane cells.

The use of a hydraulically impermeable membrane, however, presents problems should the membrane become structurally damaged, such as ruptured by the passage of a sharp object therethrough. Since commercial size filter press membrane cells comprise multiple cathode and anode units separated by a membrane, there may be up to thirteen or more membranes in each electrolytic cell unit. The exact position of a structurally damaged membrane in a electrolytic cell unit employing multiple membranes is difficult to identify without taking apart the entire filter press cell.

Typically, structural damage to one or more membranes manifests itself in several symptomatic ways. Cathode current efficiency and anode current efficiency decrease when a membrane is damaged. The cathode current efficiency decreases are detectable, such as by physically measuring the weight of the caustic produced in a container vessel and then calculating the production rate of caustic or by physically measuring the flow rate with appropriate means, for example flow totalizer units. The production rate of caustic is calculated by measuring the equivalents of caustic produced per current load and is measured in grams per gram equivalent.

The decrease in anode current efficiency is detectable because of an increase in the presence of oxygen and oxychlorides, such as hypochlorite, or chlorates, in the cell gas and the spent anolyte stream (spent brine). A change in the pH of the spent anolyte stream can also be an indicator of a decrease in anode current efficiency.

The increase in the presence of oxygen may be determined by gas chromatograph testing, while the increase in the presence of oxychlorides can be detected by titration. The oxygen and oxychlorides are present because the caustic crosses through the membrane at the point of structural damage in back migration and starts to electrolyze or chemically react with the bulk anolyte. This puts hydroxyl ions back into a low pH environment which, depending on the type of anodes being used, will produce either oxygen, chlorite ions or chlorate ions.

Previously, when testing such as this detects the presence of decreased cathode current efficiency or decreased anode efficiency, the exact location of the structurally damaged membrane could be determined only by trial and error. This required that the entire electrolytic cell be taken apart and the anodes and cathodes be separated individually to check each membrane visually for structural damage. The entire process, including the diagnosis of a problem by the detection of a reduction in the cathode current efficiency or anode current efficiency and the breaking apart of the cells to find the damaged membrane or membranes could well take several days and up to a week. A loss of this much operating time for an electrolytic cell unit is costly and the steps necessary to correct the problem in this manner are labor intensive.

The foregoing problems are solved in the method of determining the location of a structurally damaged membrane in a multiple unit filter press membrane electrolytic cell after cell operating conditions and monitoring have indicated the existence of a problem.

SUMMARY OF THE INVENTION

It is an object of the present invention to provide a method of determining the exact location of a structurally damaged membrane in a multiple unit filter press membrane electrolytic cell without having to break the entire cell apart.

It is another object of the present invention to provide a simple and reliable method to determine the exact location of a structurally damaged membrane in the filter press membrane electrolytic cell.

It is a feature of the present invention that a method of detecting the exact location of a structurally damaged membrane in a filter press membrane electrolytic cell that a test liquid is utilized to indicate the electrode adjacent to the structurally damaged membrane.

It is another feature of the method of the present invention that the test liquid flows from the adjacent electrode on one side of the membrane through the structurally damaged membrane to the adjacent electrode on the opposing side of the membrane.

It is an advantage of the method of the present invention that the entire electrolytic cell unit does not require the separation and visual inspection of each membrane to locate the structurally damaged membrane.

It is another advantage of the present invention that a minimal amount of time is expended to locate the structurally damaged membrane.

It is a further advantage of the method of the present invention that efficiency of the disassembly steps to replace a structurally damaged membrane in an electrolytic cell unit is maximized.

These and other objects, features and advantages are obtained in the method of locating a structurally damaged membrane in a filter press membrane electrolytic cell containing electrolyte by electrically disconnecting the electrolytic cell from the electrical power source, disconnecting the brine and the deionized water infeed lines, draining the electrolyte from the electrolytic cell, and filling the at least one of either the anode or cathode compartments in the electrolytic cell to permit the test liquid to pass through a structurally damaged membrane into the adjacent electrode. Passage of this test electrolyte through the structurally damaged membrane to the adjacent electrode compartment is visually observable and identifies the location of the structurally damaged membrane. The filling of the selected electrode compartments, either the anode or the cathode, may be accomplished individually one at a time or collectively all at the same time.

BRIEF DESCRIPTION OF THE DRAWINGS

The advantages of this invention will become apparent upon consideration of the following detailed disclosure of the invention, especially when it is taken in conjunction with the accompanying drawings wherein.

DETAILED DESCRIPTION OF THE PREFERRED EMBODIMENT

It is to be understood that the filter press membrane cell described in the instant disclosure includes a plurality of electrodes. Electrodes are anodes and cathodes arranged in alternating sequence as will be described in greater detail hereafter. The term "anode" or "cathode" is intended to describe the entire electrode unit which is comprised of a frame that encases the periphery of the appropriate electrode and on opposing sides has anodic or cathodic surfaces, as appropriate. The space within the individual electrode between the electrode surfaces comprises a major portion of the compartment which is filled with anolyte or catholyte fluid, as appropriate during the electrolytic process. The particular compartment is defined by the pair of membranes that are placed adjacent, but exteriorly of the opposing electrode surfaces, thereby including the opposing electrode surfaces within each compartment. The term "anode" or "cathode" is further intended to encompass the electrical conductor rods that pass the current through the appropriate electrode, as well as any other element that comprise the entire electrode unit.

Figure 1:
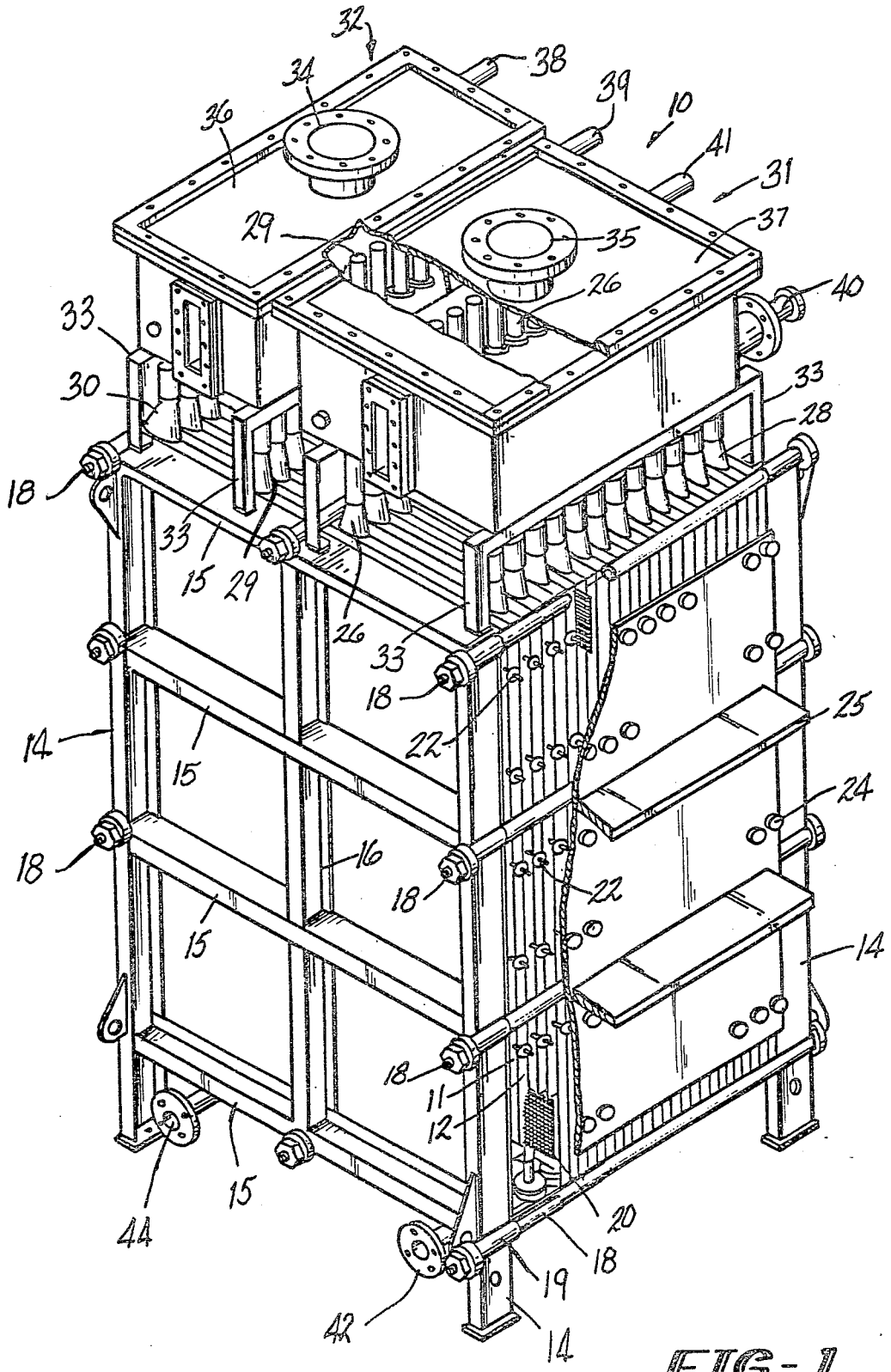
FIG. 1 is a side perspective view of a monopolar filter press membrane electrolytic cell with appropriate portions broken away to illustrate the anodes, cathodes, anolyte disengager, catholyte disengager, the anolyte and catholyte infeed manifolds, and the relative positioning of the membranes between the adjacent anodes and cathodes.

Referring now to FIG. 1, a filter press membrane cell, indicated generally by the numeral 10, is shown in a side perspective view. It can be seen that the cathodes 11 and anodes 12 alternate and are oriented generally vertically. The cathodes 11 and anodes 12 are supported by vertical side frame members 14, horizontal side frame members 15, and intermediate vertical side frame members 16 (only one of which is shown). The cathodes 11 and anodes 12 are pressed together and secured by a series of tie bolts 18 which are inserted through appropriate mounting means affixed to the vertical side frame members 14 and horizontal side frame members 15. To prevent short circuiting between the electrodes during the electrolytic process, the tie bolts 18 have tie bolt insulators 19 through which the tie bolts 18 are passed in the area of the cathodes 11 and anodes 12.

Figure 2:
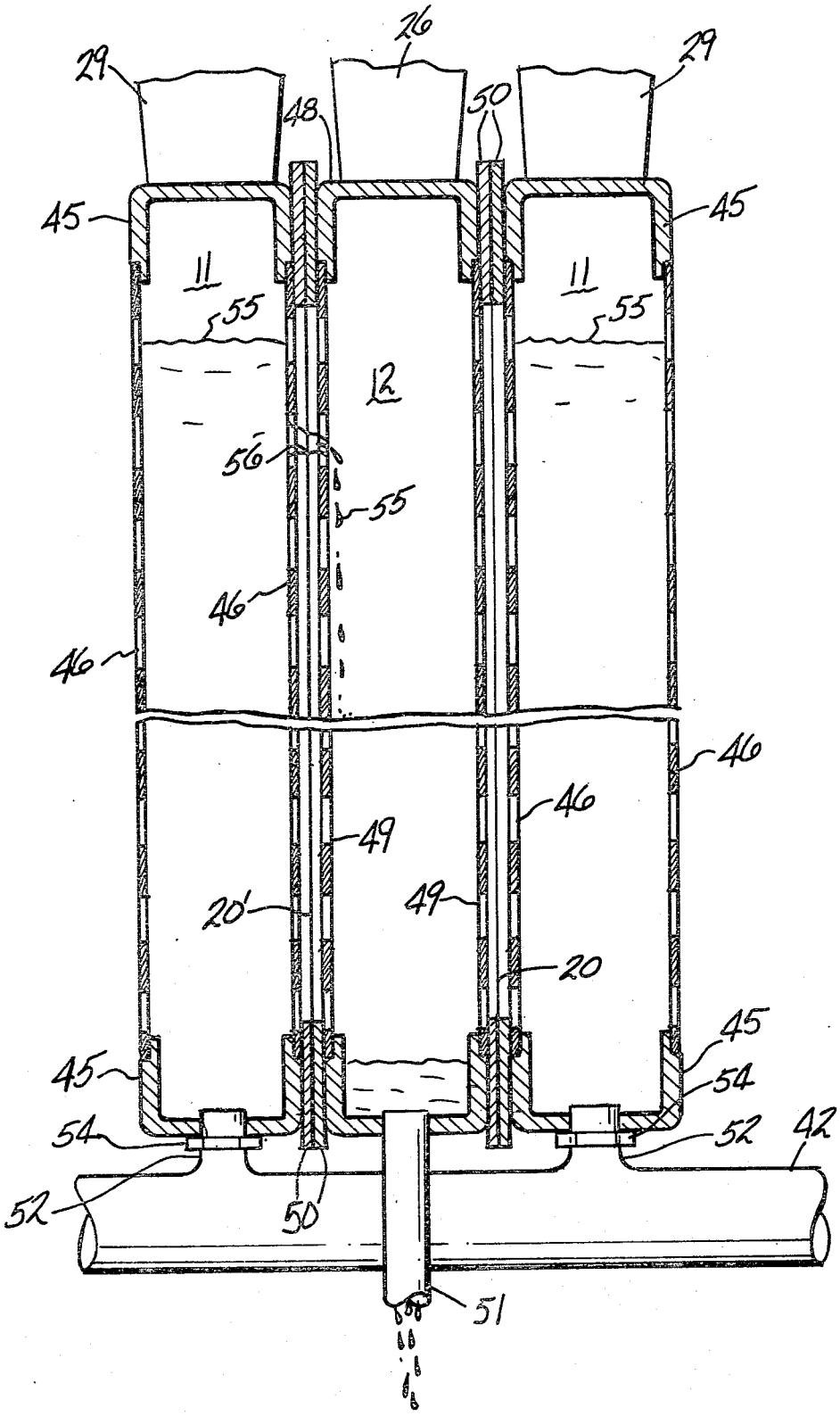
FIG. 2 is an enlarged diagramatic sectional illustration of adjacently positioned anode and cathodes with a structurally damaged membrane therebetween showing the passage of the test liquid through the structurally damaged membrane into the adjacent electrode.
Figure 1:
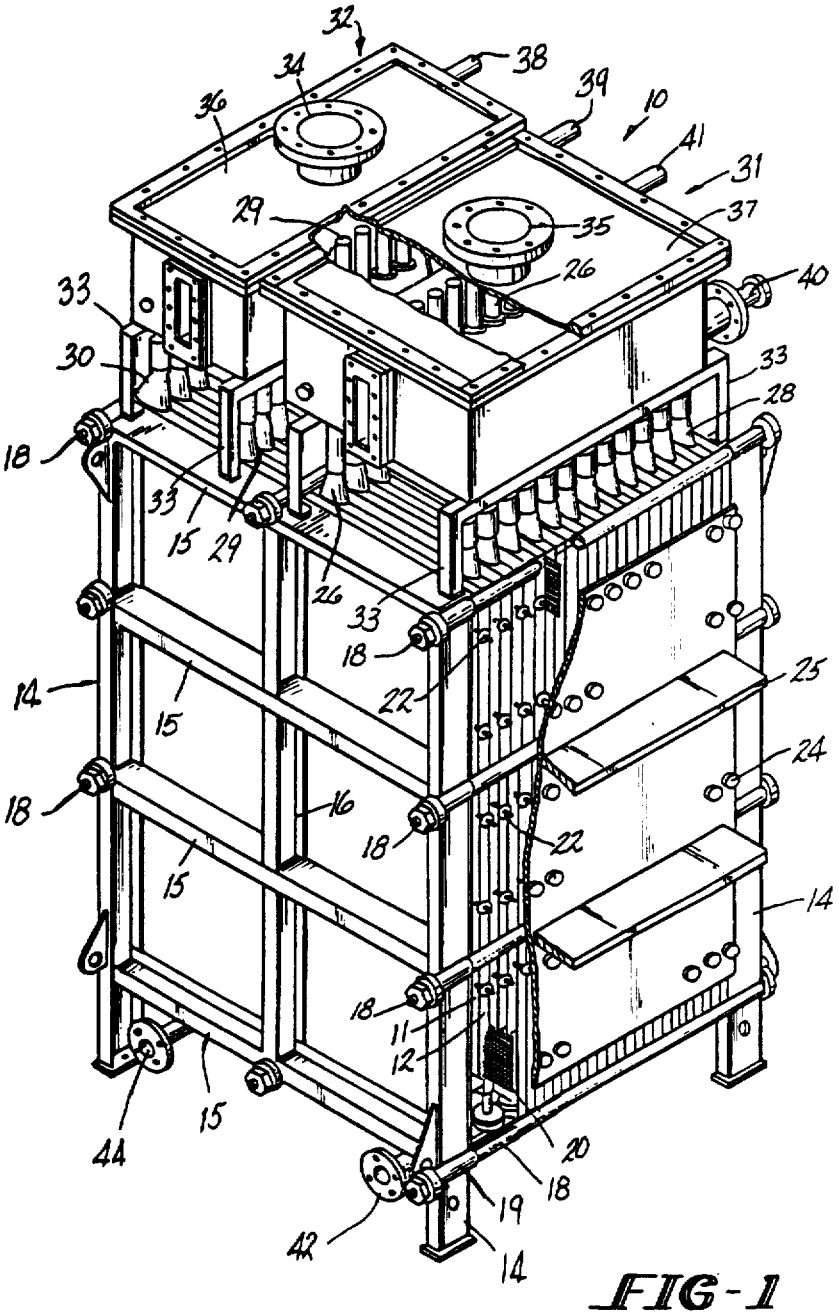
Figure 2:
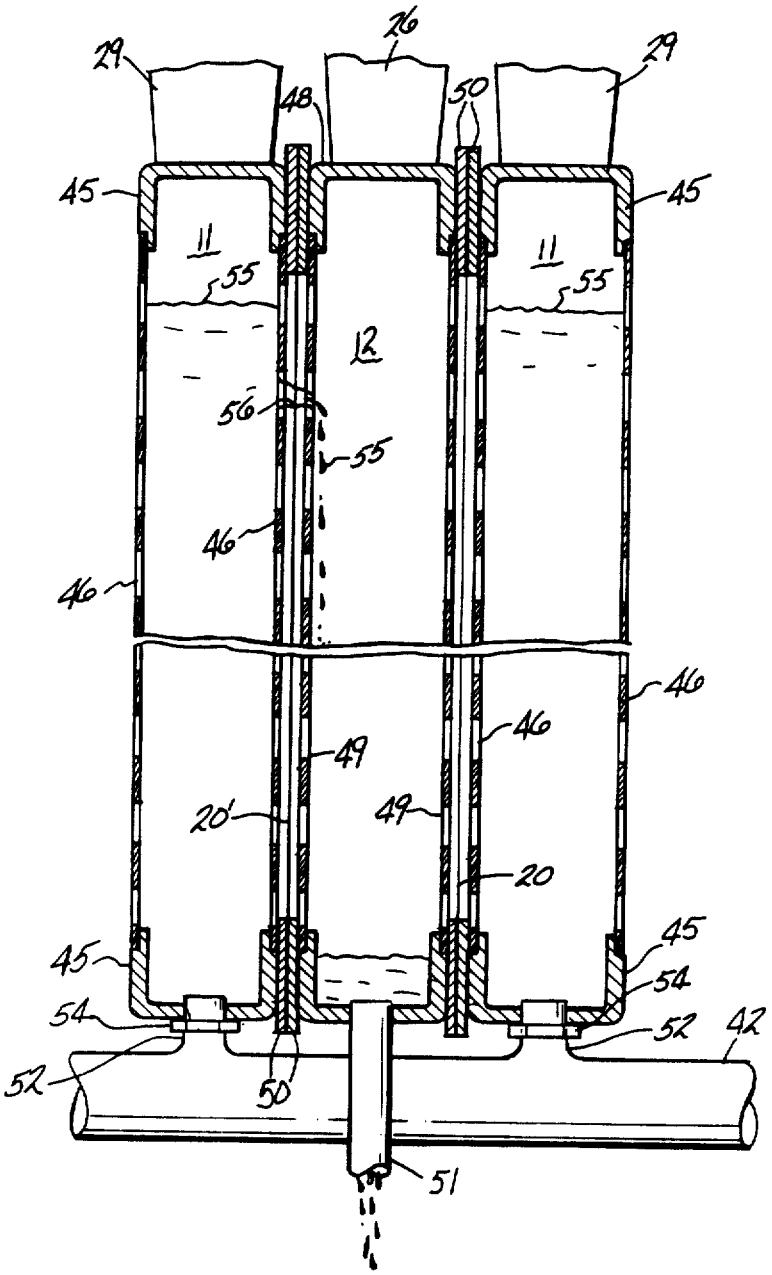

Electrical current is passed, for example, from an external power source through the anode bus and then via anode bus bolts into the anode conductor rods, all not shown. From that point, the anode conductor rods pass the current into the anodic surfaces, also not shown in FIG. 1. The current continues flowing through the membrane 20, through the opposing cathodic surfaces (not shown in FIG. 1), the cathode conductor rods 22 and the cathode bus bolts 24 to the cathode bus 25. At this point the electrical current continues its path out of the cell 10. The anodic conducting means are present on the opposite side of the filter press membrane cell 10 from the cathodic conducting means. Ion-selective permeable membranes 20 are diagramatically shown in FIG. 1 to illustrate how each pair of anodes 12 and cathodes 11 are separated by the membranes. FIG. 2 shows this in better detail.

Projecting from the top of anodes 12 and cathodes 11 are a series of anode and cathode risers used for fluid flow between the appropriate gas-liquid disengager and the corresponding electrode. FIGS. 1 and 2 show anode risers 26 and anode downcomers 28, which project from the top of each anode 12. Similarly, cathode risers 29 and cathode downcomers or catholyte return lines 30 are shown projecting from the top of each cathode 11. The risers are generally utilized to carry the appropriate electrolyte fluid with the accompanying gas, either anolyte with chlorine gas or catholyte with hydrogen gas, to the appropriate disengager mounted atop of the filter press membrane cell 10.

The anolyte disengager is indicated generally by the numeral 31, while the catholyte disengager is indicated generally by the numeral 32. Each disengager is supported atop of the cell 10 by disengager supports 33, seen in FIG. 1. It is in each of these disengagers that the entrained gases is enabled to separate from the liquid of the anolyte or the catholyte fluid, as appropriate, and is released from the appropriate disengager via either a cathode gas release pipe 34 or an anode gas release pipe 35 affixed to the appropriate catholyte disengager cover 36 or anolyte disengager cover 37.

Also partially illustrated in FIG. 1 is a catholyte replenisher or infeed conduit 38 which carries deionized water into the catholyte disengager 32. Deionized water is appropriately fed through the catholyte disengager 32 to each cathode frame 11 in cell 10. A catholyte outlet pipe 39 is also partially illustrated and serves to control the level of liquid fluid in the catholyte disengager 32 by removing caustic to the appropriate processing apparatus.

An anolyte replenisher or brine infeed conduit 40 carries fresh brine into the anolyte disengager 31 and is best seen in FIG. 1. The fresh brine is then appropriately fed into each anode frame 12 with the existing anolyte fluid, which is recirculated from the anolyte disengager 31 into each anode frame 12 via the anode downcomers 28. An anolyte outlet pipe 41 is also partially shown and serves to control the level of liquid in the anolyte fluid within the anolyte disengager 31 by removing the spent brine from the disengager 31 for regeneration.

Also partially shown in FIG. 1 are a catholyte bottom infeed manifold 42 and an anolyte bottom infeed manifold 44, which are used to drain the appropriate electrodes.

The filter press membrane cell 10 has been described only generally since the structure and function of its central components are well known to one of skill in the art.

Turning now to FIG. 2, there is shown in partial sectional view a diagramatic illustration of three electrodes adjacently positioned from the filter press membrane electrolytic cell 10. The cathodes 11 have cathode frames 45 to which are fastened the opposing cathodic surfaces 46. The anode 12 has anode frame 48 to which is fastened the opposing anodic surfaces 49. Membranes 20 separate the adjacent anodic surfaces 49 and cathodic surfaces 46. Gaskets 50 may be employed between the adjacent cathode frames 45 and anode frames 48 to effect a liquid-tight seal. To prevent tearing of the membrane between the adjacent gaskets 50, a teflon strip (not shown) may be placed on both sides of the membrane 20 between the gaskets 50.

Anolyte infeed pipes 51 (only one of which is shown) can extend upwardly through the bottoms of anode frames 48 of anodes 12. Similarly, catholyte infeed pipes 52 extend upwardly through the bottoms of cathode frames 45 of cathodes 11. Couplings 54 permit the catholyte infeed pipes 52 to be removably connected to the catholyte bottom infeed manifold 42. Anolyte infeed pipes 51, only one of which is shown, also have couplings (not shown) which permit the anolyte bottom infeed manifold 44 to be removably connected thereto.

As seen in FIG. 2, a test liquid 55 has been injected upwardly through the catholyte bottom infeed manifold 42 and the catholyte infeed pipes 52 to fill the cathodes 11 to a desired level. A structurally damaged membrane 20′ is shown with the structural damage indicated at location 56. The structural damage at location 56, generally any sort of a perforation that permits liquid to pass through, permits back migration of the electrolyte caustic into the anode 12. In FIG. 2, this back migration is indicated by the drip of test liquid 55 into the adjacent anode 12.

The method of the instant invention may be employed when electrolytic cell monitoring determines that there is reduced cathode current efficiency and reduced anode current efficiency in the operating conditions of the cell. Titration of the spent brine confirming an increase in the presence of oxychlorides and gas chromatographs of the cell gas confirming an increase in the presence of oxygen normally indicate a structurally damaged membrane within the operating electrode cell unit. Upon such detection, the location of the structurally damaged membrane may be determined by the following method.

The electrolytic cell 10 is electrically disconnected from the electrical power source and the power supply line. This is done by removing the intercell connectors (not shown) connecting the anode bus (not shown) and the cathode bus 25 from the adjacent cells. The deionized water infeed line or catholyte replenisher conduit 38 is disconnected or appropriately shut off, such as by means of a valve, to prevent the continued flow of deionized water into the cell 10. Similarly, the fresh brine infeed line or anolyte replenisher conduit 40 is disconnected or shut off, such as by an appropriate valving mechanism, to prevent the continued flow of fresh brine into the electrolytic cell 10.

The cathodes 11 and anodes 12 are then drained of all electrolyte through the catholyte bottom infeed manifold 42 and the anolyte bottom infeed manifold 44. This may be accomplished by either disconnecting the conduits or flow pipes (not shown) which connect to these manifolds or the use of a valve system in the conduits or flow pipes which permits the electrolyte to predrain out from the catholyte bottom infeed manifold 42 and the anolyte bottom infeed manifold 44.

Once the electrolyte is completely drained from both the cathodes 11 and anodes 12, the anolyte bottom infeed manifold 44 is disconnected by means of the couplings (not shown) and removed. Once thus removed, the cathodes 11 are ready to be filled with a test liquid. The test liquid can be fed into the cathodes 11 in any appropriate manner, either individually one at a time or simultaneously all at one time . A preferred method is the feeding of the test liquid into the cathodes 11 from the bottom. This may be accomplished by connecting a test liquid feed line to the catholyte bottom infeed manifold 42. The test liquid 55 is forced into the manifold 42 and upwardly through the catholyte infeed pipes 52 into the individual cathodes 11. The test liquid 55 is only put into the cathodes 11 and is filled to levels so that the membranes 20 separating the adjacent anodes 12 and cathodes 11 are totally covered by the test liquid 55. This is generally to the level that the test liquid 55 rises up into the cathode risers 29.

Any cathodes 11 that are adjacent to structurally damaged membranes 20′ will have the test liquid 55 pass therethrough into the adjacent anode 12. The test liquid 55 will drip down into the bottom of the anode 12, accumulating at the bottom of the anode frame 48 and passing outwardly through the anolyte infeed pipe 51. When this flow of test liquid 55 draining out of the bottom of the anode 12 adjacent the structurally damaged membrane 20′ is observed, the location of the structurally damaged membrane has been thus determined to be adjacent to the anode 12 from which the test liquid 55 is draining. The electrolytic cell 10 should then be separated to expose the structurally damaged membrane 20′ so that it may be inspected and removed from this electrolytic cell 10, if necessary. Since the structurally damaged membrane could be on the adjacent membrane, shown as membrane 20 in FIG. 2, the electrolytic cell 10 should also be broken apart at the adjacent membrane 20-anode 12 interface to ensure that there is no structural damage to the opposing membrane 20.

It is to be noted that test liquid 55 can equally well be filled into the anode 12 with the anolyte infeed manifold 44 left connected to the electolytic cell 10 and the catholyte bottom infeed manifold 42 removed. Structurally damaged membrane 20′ still permits the test liquid to pass from the anode 12 adjacent the structurally damaged membrane 20′ into the adjacent cathode 11 from which the test liquid 55 could be seen draining through the bottom catholyte infeed pipe 52.

An alternative method of locating a structurally damaged membrane may be employed. In this method the electrolytic cell 10 is disconnected from the electrolytical power source, the fresh brine or anolyte replenisher conduit 40 and the deionized water or catholyte replenisher conduit 38 are disconnected or shut off, and the electrolyte is drained from the electrolytic cell as accomplished in the previous method. However, the anolyte infeed manifold 44 is removed from the electrolytic cell and replaced with a valved infeed manifold that permits the individual anodes 12 to be isolated from each other so that test liquid level equilibration between anodes 12 by flow through the infeed manifold 44, into the adjacent anodes 12 does not occur. The anodes 12 and the cathodes 11 are then filled with the test liquid 55. However, a predetermined positive differential, preferably approximately twenty inches between the fill height of the test liquid 55 in the cathodes 11 and the fill height of the test liquid 55 in the anodes 12 is maintained. The filling of the cathodes 11 and the anodes 12 with the test liquid 55 is stopped when the test liquid 55 flows out of the top product nozzle or cathode riser 29 of each cathode 11. Each individual anode 12 is isolated by using the shut off valves on the new anolyte infeed manifold. The test liquid 55 will then pass through the structurally damaged membrane 20' into the adjacent anode 12. This will cause the level of test fluid in the anode 12 adjacent the structurally damaged membrane 20' to rise in height until the level of test liquid 55 between the adjacent cathode 11 and anode 12 are almost equal. By this method, the location of the anode adjacent the structurally damaged membrane can be determined. The cell is then separated as before.

Additionally,in the second method of locating a structurally damaged membrane, a compatible dye or other indicator can be used in the test liquid 55 put in the cathodes 11 so that the flow of test liquid 55 across a structurally damaged membrane 20' will be visibly noticeable. Air or other compatible gases can also be employed to pressurize the desired chamber, either cathode 11 or anode 12, to detect the leak through the structurally damaged membrane 20'. This second method of locating a structurally damaged membrane could equally well reverse the positive test liquid differential and maintain a predetermined positive test liquid fill height differential on the anodes 12, as well as replacing the catholyte infeed manifold 42 with a valved infeed mainfold to effect test liquid 55 isolation between the adjacent cathodes 11.

The instant method of locating a structurally damaged membrane or electrode separator can be employed equally well in electrolytic cells using a finite gap between the membrane or separator and the adjacent electrode surfaces or in electrolytic cells where the membrane or separator is in contact with or bonded to the adjacent electrode surfaces.

It should also be noted that this procedure may be employed on bipolar or monopolar filter press membrane cells and any type of hydraulically impermeable ion exchange membrane may be used as the electrode separator between the adjacent electrode. In the case of bipolar cells, alternate adjacent electrodes, sandwiched about the electrode separator, would be filled with the test liquid. The other empty adjacent electrode would then be observed for leakage of any of the test liquid through the structurally damaged separator into the empty compartment.

While the preferred structure in which the principles of the present invention have been incorporated is shown and described above, it is to be understood that the invention is not to be limited to the particular details thus presented, but in fact, widely different means may be employed in the practice of the broader aspects of the method of this invention. The scope of the appended claims is intended to encompass all obvious changes in the details, materials and method of utilizing the parts which will occur to one of skill in the art upon a reading of the disclosure.

Having thus described in the invention, what is claimed is:

1. A method of locating a structurally damaged membrane in a filter press membrane electrolytic cell filled with electrolyte having an anolyte infeed manifold, a catholyte infeed manifold, deionized water infeed, brine infeed, a product caustic outlet, a product chlorine outlet, and a plurality of anodes and cathodes, each pair of anodes and cathodes being sandwiched about a membrane, comprising:

a. electrically disconnecting the electrolytic cell from the electrical power source;
b. disconnecting and sealing the brine and deionized water infeed;
c. draining the electrolyte from the electrolytic cell;
d. removing the anolyte infeed manifold from the electrolytic cell;
e. filling the cathodes with a test liquid;
f. having the test liquid pass through a structurally damaged membrane into the adjacent anodes; and
g. observing the test liquid in the anode adjacent the structurally damaged membrane.

2. The method according to claim 1 further comprising feeding the test liquid into the cathodes through the catholyte infeed manifold.

3. The method according to claim 1 further comprising using water as the test liquid.

4. The method according to claim 1 further comprising using a brine as the test liquid.

5. The method according to claim 1 further comprising using caustic as the test liquid.

6. A method of locating a structurally damaged membrane in a filter press membrane electrolytic cell filled with electrolyte having an anolyte infeed manifold, a catholyte infeed manifold, a brine infeed, deionized water infeed, product caustic outlet, product chlorine outlet, and a plurality of anodes and cathodes, each pair of anodes and cathodes being sandwiched about a membrane, comprising:

a. electrically disconnecting the electrolytic cell from the electrical power source;
b. disconnecting and sealing the brine infeed and the deionized water infeed;
c. draining the electrolyte from the electrolytic cell;
d. removing the catholyte infeed manifold from the electrolytic cell;
e. filling the anodes with a test liquid;
f. having the test liquid pass through a structurally damaged membrane into the adjacent cathode; and
g. observing the test liquid in the cathode adjacent the structurally damaged membrane.

7. The method according to claim 6 further comprising feeding the test liquid through the anolyte infeed manifold into the anodes.

8. The method according to claim 6 further comprising using water as the test liquid.

9. The method according to claim 6 further comprising using a brine as the test liquid.

10. The method according to claim 6 further comprising using caustic as the test liquid.

11. A method of locating a structurally damaged membrane in a filter press membrane electrolytic cell filled with electrolyte having an anolyte infeed manifold, a catholyte infeed manifold, a brine infeed, deionized water infeed, product caustic outlet, product chlorine outlet, and a plurality of anodes and cathodes, each pair of anodes and cathodes being sandwiched about a membrane and having top product risers, comprising:

a. electrically disconnecting the electrolytic cell from the electric power source;
b. disconnecting the brine and deionized water infeed;
c. draining the electrolyte from the electrolytic cell;
d. removing the anolyte infeed manifold from the electrolytic cell and replacing it with a valved infeed manifold that permits the isolation of the individual anodes;
e. filling the cathodes and anodes with a test liquid, maintaining a predetermined positive cathode to anode differential in the fill height level;
f. stopping the filling of the anodes and cathodes with the test liquid when the cathodes overflow through the top product risers with the test liquid;
g. isolating each individual anode by using the shut-off valves on the anolyte manifold;
h. having a test liquid pass through a structurally damaged membrane into the adjacent anode; and
i. observing the test liquid level in each of the anodes to determine which anode has the liquid level rising to locate the anode adjacent the structurally damaged membrane.

12. A method of locating a structurally damaged membrane in a filter press membrane electrolytic cell filled with electrolyte having an anolyte infeed manifold, a catholyte infeed manifold, a brine infeed, deionized water infeed, product caustic outlet, product chlorine outlet, and a plurality of anodes and cathodes, each pair of anodes and cathodes being sandwiched about a membrane and having top product risers, comprising:
a. electrically disconnecting the electrolytic cell from the electric power source;
b. disconnecting the brine and deionized water infeed;
c. draining the electrolyte from the electrolytic cell;
d. removing the catholyte infeed manifold from the electrolytic cell and replacing it with a valved infeed manifold that permits the isolation of the individual anodes;
e. filling the cathodes and anodes with a test liquid, maintaining a predetermined positive anode to cathode differential in the fill height level;
f. stopping the filling of the anodes and cathodes with the test liquid when the anodes overflow through the top product risers with the test liquid;
g. isolating each individual cathode by using the shut-off valves on the catholyte manifold;
h. having a test liquid pass through a structurally damaged membrane into the adjacent cathode; and
i. observing the test liquid level in each of the cathodes to determine which cathode has the liquid level rising to locate the cathode adjacent the structurally damaged membrane.

13. A method of locating a structurally damaged membrane in a bipolar filter press membrane electrolytic cell filled with electrolyte having a plurality of adjacently positioned electrodes, each pair of electrodes being sandwiched about a membrane, the cell having at least one structurally damaged membrane, an anolyte infeed manifold, a catholyte infeed manifold, a brine infeed, a deionized water infeed, liquid product outlet means, and gas product outlet means, the method comprising:
a. electrically disconnecting the electrolytic cell from the electric power source;
b. disconnecting the brine infeed and the deionized water infeed;
c. draining the electrolyte from the electrolytic cell;
d. removing one of the electrolyte infeed manifolds;
e. filling the first of each pair of adjacently positioned electrodes with a test liquid;
f. having the test liquid pass through a structurally damaged membrane into the adjacent unfilled electrode; and
g. observing the adjacent unfilled electrodes for the presence of the test liquid passing through the structurally damaged membrane.

14. The method according to claim 13 further comprising removing the anolyte infeed manifold.

15. The method according to claim 13 further comprising removing the catholyte infeed manifold.

16. The method according to claim 1 further comprising observing the test liquid drain out of the bottom of the anode adjacent the structurally damaged membrane.

17. The method according to claim 6 further comprising observing the test liquid drain out of the bottom of the cathode adjacent the structurally damaged membrane.

* * * * *

UNITED STATES PATENT AND TRADEMARK OFFICE

CERTIFICATE OF CORRECTION

PATENT NO. : 4,431,495

DATED : February 14, 1984

INVENTOR(S) : David L. Fair et al.

It is certified that error appears in the above-identified patent and that said Letters Patent is hereby corrected as shown below:

The title page should be deleted to appear as per attached title page.

Sheets 1 and 2 of the drawings should be deleted to appear as per attached sheets.

Signed and Sealed this

*Twenty-seventh* Day of *November 1984*

[SEAL]

*Attest:*

GERALD J. MOSSINGHOFF

*Attesting Officer*

*Commissioner of Patents and Trademarks*

United States Patent [19]
Fair et al.

[11] 4,431,495
[45] Feb. 14, 1984

[54] LOCATION OF A STRUCTURALLY DAMAGED MEMBRANE

[75] Inventors: David L. Fair, Chattanooga; Kenneth E. Woodard, Jr.; David A. Helmstetter, both of Cleveland, all of Tenn.

[73] Assignee: Olin Corporation, New Haven, Conn.

[21] Appl. No.: 489,968

[22] Filed: Apr. 29, 1983

[51] Int. Cl.[3] ..... C25B 1/08; C25B 1/46
[52] U.S. Cl. ..... 204/98; 204/128; 204/257; 204/258; 73/40
[58] Field of Search ..... 204/98, 128, 257, 258; 73/40

[56] References Cited

U.S. PATENT DOCUMENTS

| | | | |
|---|---|---|---|
| 3,811,317 | 5/1974 | Leonard et al. | 73/40 |
| 3,937,064 | 2/1976 | Wolf, Jr. et al. | 73/40 |
| 4,090,924 | 5/1978 | Bon | 204/98 |

*Primary Examiner*—R. L. Andrews
*Assistant Examiner*—Terryence Chapman
*Attorney, Agent, or Firm*—Ralph D'Alessandro; Donald F. Clements; Thomas P. O'Day

[57] ABSTRACT

Disclosed is a method of determining which membrane in a multiple unit filter press membrane electrolytic cell is structurally damaged after cell operating conditions and monitorings indicate the problem exists.

17 Claims, 2 Drawing Figures

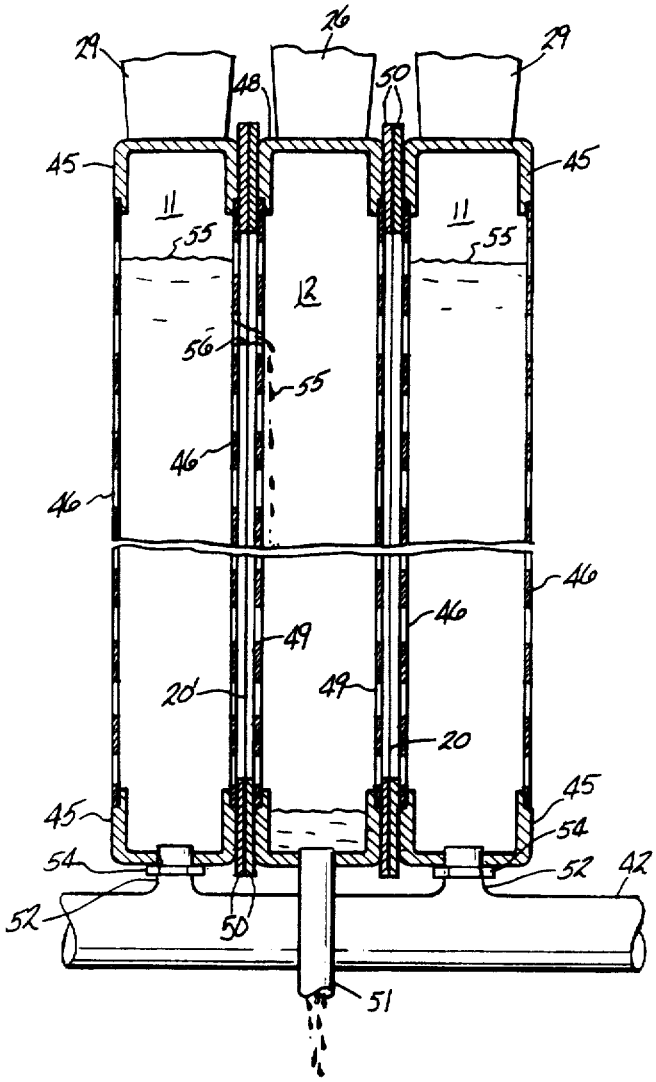

UNITED STATES PATENT AND TRADEMARK OFFICE

CERTIFICATE OF CORRECTION

PATENT NO. : 4,431,495

DATED : February 14, 1984

INVENTOR(S) : Fair et al

It is certified that error appears in the above-identified patent and that said Letters Patent is hereby corrected as shown below:

Column 9, line 44, "anodes" should read -- cathodes --.

Signed and Sealed this

*Twenty-first* Day of *May 1985*

[SEAL]

*Attest:*

DONALD J. QUIGG

*Attesting Officer*

*Acting Commissioner of Patents and Trademarks*